US006669194B2

(12) United States Patent
Houston, Jr.

(10) Patent No.: US 6,669,194 B2
(45) Date of Patent: Dec. 30, 2003

(54) MARBLE TABLE

(76) Inventor: Isiah Houston, Jr., 24 Ida Red Ave., #204, Sparta, MI (US) 49345

( * ) Notice: Subject to any disclaimer, the term of this patent is extended or adjusted under 35 U.S.C. 154(b) by 0 days.

(21) Appl. No.: 10/230,892

(22) Filed: Aug. 29, 2002

(65) Prior Publication Data

US 2003/0042671 A1 Mar. 6, 2003

Related U.S. Application Data

(60) Provisional application No. 60/316,102, filed on Aug. 30, 2001.

(51) Int. Cl.[7] ..... A63F 7/00
(52) U.S. Cl. ..... 273/118 R; 273/123 R
(58) Field of Search ..... 273/148 R, 309, 273/118 R, 123 R, 119 R

(56) References Cited

U.S. PATENT DOCUMENTS

| | | | | |
|---|---|---|---|---|
| 155,635 A | | 10/1874 | Brotherton | |
| 1,151,470 A | | 8/1915 | Kade | |
| 2,636,740 A | | 4/1953 | McNeal | |
| 2,639,151 A | | 5/1953 | Kennon | |
| 2,943,858 A | | 7/1960 | Slater | |
| 3,001,843 A | | 9/1961 | Davis | |
| 3,166,325 A | | 1/1965 | First | |
| D205,141 S | | 6/1966 | Seebeck | |
| 3,526,404 A | | 9/1970 | Wiggins | |
| 3,658,328 A | | 4/1972 | Kooker | |
| 3,687,092 A | | 8/1972 | Manning | |
| 3,858,529 A | | 1/1975 | Salladay | |
| 4,179,122 A | | 12/1979 | Ray | |
| 4,445,689 A | | 5/1984 | Rainey | |
| 4,445,690 A | | 5/1984 | Cairns | |
| 4,474,374 A | * | 10/1984 | Lewis et al. | 473/14 |
| 4,549,737 A | * | 10/1985 | Seyer et al. | 273/118 R |
| 4,699,381 A | | 10/1987 | Vaughn | |
| 5,039,099 A | | 8/1991 | Bravo | |
| 5,139,259 A | | 8/1992 | Yeakley | |
| 5,222,736 A | | 6/1993 | Workman et al. | |
| 5,564,697 A | | 10/1996 | Catrinar | |
| 6,419,224 B1 | * | 7/2002 | Tsai | 273/108.1 |
| 2003/0042671 A1 | * | 3/2003 | Houston, Jr. | 273/118 R |

FOREIGN PATENT DOCUMENTS

| | | | | |
|---|---|---|---|---|
| GB | 2111827 | * | 7/1983 | A47B/3/12 |

OTHER PUBLICATIONS

Certificate of Registration and deposit material for "Classic Table Marbles," by Isiah Houston, Jr., Apr. 10, 1995 (5 pages).

"Marble Dreams," Jason Wilson, Apr. 23, 2000, pp. 13–27.

* cited by examiner

*Primary Examiner*—Raleigh W. Chiu
(74) *Attorney, Agent, or Firm*—Price, Heneveld, Cooper, DeWitt & Litton

(57) ABSTRACT

A marble playing table assembly that typically includes a table portion, a removable playing surface, and a removable marble table section. The table portion typically includes a support surface and at least one downwardly extending support member. The bottom surface of the removable playing surface typically has at least one support peg receiving cavity and at least one playing surface alignment mark. The removable marble table section may have an upright marble retention section defining a sloped center section. The removable marble table section may also include an inwardly projecting portion and at least one support peg engaged to the sloped center section. The removable marble table section removably engages the support surface of the table portion and at least one support peg may engage at least one support peg receiving cavity when the playing surface is engaged with the removable marble table section.

27 Claims, 7 Drawing Sheets

MARBLE TABLE

CROSS-REFERENCE TO RELATED APPLICATIONS

This application claims priority under 35 U.S.C. §119(e) on U.S. Provisional Application No. 60/316,102, entitled MARBLE TABLE, filed on Aug. 30, 2001, by Isiah Houston, Jr., the entire disclosure of which is incorporated herein by reference.

BACKGROUND OF THE INVENTION

Marbles are, of course, small, hard balls made from clay, stone, glass, steel, wood, or any other suitable material. Children and adults have played the game of marbles for thousands of years beginning first with the Romans and in ancient Egypt. A marble made of pure marble or other suitable stone is highly priced and generally regarded as being the most accurate for shooting. However, they are also the most expensive and rare. On the other hand, clay marbles tend to be relatively inexpensive, but tend to have inaccurate dimensions and a dull appearance. Today, glass marbles are most typical.

Traditionally, marble games are played on the ground. To play traditional marbles, players begin by drawing a circle that is three to ten feet in diameter. The diameter of the circle is determined by the skill of the players. Players with greater skill utilize a larger diameter circle. Players put thirteen mibs (smaller marbles that are typically about ⅝ of an inch in diameter) in the center of the circle. The players then decide whether they will play for "keepsies" (playing for ownership of the marbles you win) or just for fun. Once decided, the game begins by one player placing their knuckles on the ground outside the ring and flicking their shooter marble or Taw (a larger typically more expensive marble having a diameter of at least ½ inch, but not more than ¾ inch in diameter) at the other marbles within the ring attempting to knock the mibs out of the circle while not shooting the Taw out of the circle. If the player is successful, the player shoots again. Of course, there are numerous other marble games that can be played as well.

Because of the historical and continued popularity of marble games with both children and adults, there is a significant need for an adaptable marble playing table that can be played in a more traditional fashion—at ground level—or in a elevated game table environment.

The present invention generally relates to game tables and their components. More particularly, the present invention relates to adjustable marble game tables and the components used to construct such tables.

SUMMARY OF THE INVENTION

One embodiment of the present invention is directed toward a marble playing table assembly that typically includes: a table portion; a removable playing surface; and a removable marble table section. The table portion typically includes a support surface and at least one downwardly extending support member attached to the support surface and may include a leveling adjustment device. The removable playing surface has a top surface and a bottom surface. The bottom surface may have at least one support peg receiving cavity and at least one playing surface alignment mark. The removable marble table section has an upright marble retention section which defines a sloped center section, a bottom surface, an inwardly projecting portion, and at least one support peg. The support peg(s) are connected to the sloped center section for suspending the removable playing surface substantially level above the sloped center section. The sloped center section further includes a table section alignment mark. The removable marble table section removably engages the support surface of the table portion. At least one support peg connects to at least one support peg receiving cavity when the playing surface alignment mark and the table section alignment mark are aligned with one another.

Another embodiment of the present invention includes a marble playing table assembly having: a removable marble table section receiving support table; a removable playing surface; and a substantially wood removable marble table section. The removable marble table section receiving support table includes a substantially flat removable marble table section receiving surface and at least one downwardly extending support member which engages the substantially flat support surface. Any number of the downwardly extending support member may also include a leveling adjustment device. The removable playing surface has a top surface and a bottom surface that includes at least one support peg receiving cavity and at least one playing surface alignment mark. The removable marble table section includes an upright marble retention section which defines a sloped center section. The sloped center section typically has a diameter greater than the diameter of the playing surface and a bottom surface. The removable marble table section may further include a marble return opening where the sloped center section directs marbles that have fallen off the removable playing surface toward the marble return opening. The removable marble table section also may include an inwardly projecting portion which extends over at least a portion of the removable playing surface. The inwardly projecting portion may have at least one bubble level for facilitating the leveling of the marble table. The sloped center section also may include a table section alignment mark and a number of support pegs which correspond to the number of support peg receiving cavities on the bottom surface of the removable playing surface. The sloped center section and support pegs suspend the removable playing surface substantially level above the sloped center section. The support pegs typically include support peg knobs which engage the support peg receiving cavities on the bottom surface of the removable playing surface. The support peg knobs matingly engage the support peg cavities when the playing surface alignment mark and the table section alignment mark are aligned with one another. The removable marble table section may engage the support surface by utilizing at least one engagement device, which, for a period of time, locks the removable marble table section in a substantially fixed positive engaged with the removable marble table section receiving support table.

In yet another embodiment of the present invention, a marble table assembly that typically includes: a table support surface and at least one support leg engaged with the support surface. The removable playing surface having a top surface and a bottom surface where the bottom surface has at least one support peg receiving cavity. The removable marble table section typically has an upright marble retention section defining a sloped center section and a bottom surface. The removable marble table section includes a number of support pegs corresponding to the number of support peg receiving cavities on the bottom surface of the removable playing surface. The support pegs and the support peg receiving cavities support the removable playing surface above the sloped center section. The removable marble table section removably engages the support surface, which allows the playing surface or the entire marble table section optionally to be disengaged from the table and used at a location other than in connection with the table.

A further embodiment of the present invention includes a marble table assembly typically having: a support table; a number of removable playing surfaces that each have different diameters to accommodate marble players having a variety of skill levels; and a marble table section. The support table typically includes a support surface and at least one downwardly extending support connected to the support surface. Any member of the downwardly extending supports may also include a leveling adjustment device. Each removable playing surface includes a top surface and a bottom surface. The bottom surface may have at least one support peg receiving cavity. The marble table section typically has an upright marble retention section defining a sloped center section where the sloped center section has a diameter equal to or less than the diameter of the largest playing surface. The marble table section has a bottom surface and at least one support peg engaged to the sloped center section for suspending the removable playing surfaces substantially level and above the sloped center section.

These and other features, advantages and objects of the present invention will be further understood and appreciated by those skilled in the art by reference to the following specification, claims and appended drawings.

DETAILED DESCRIPTION OF PREFERRED EMBODIMENT

Figure 10:
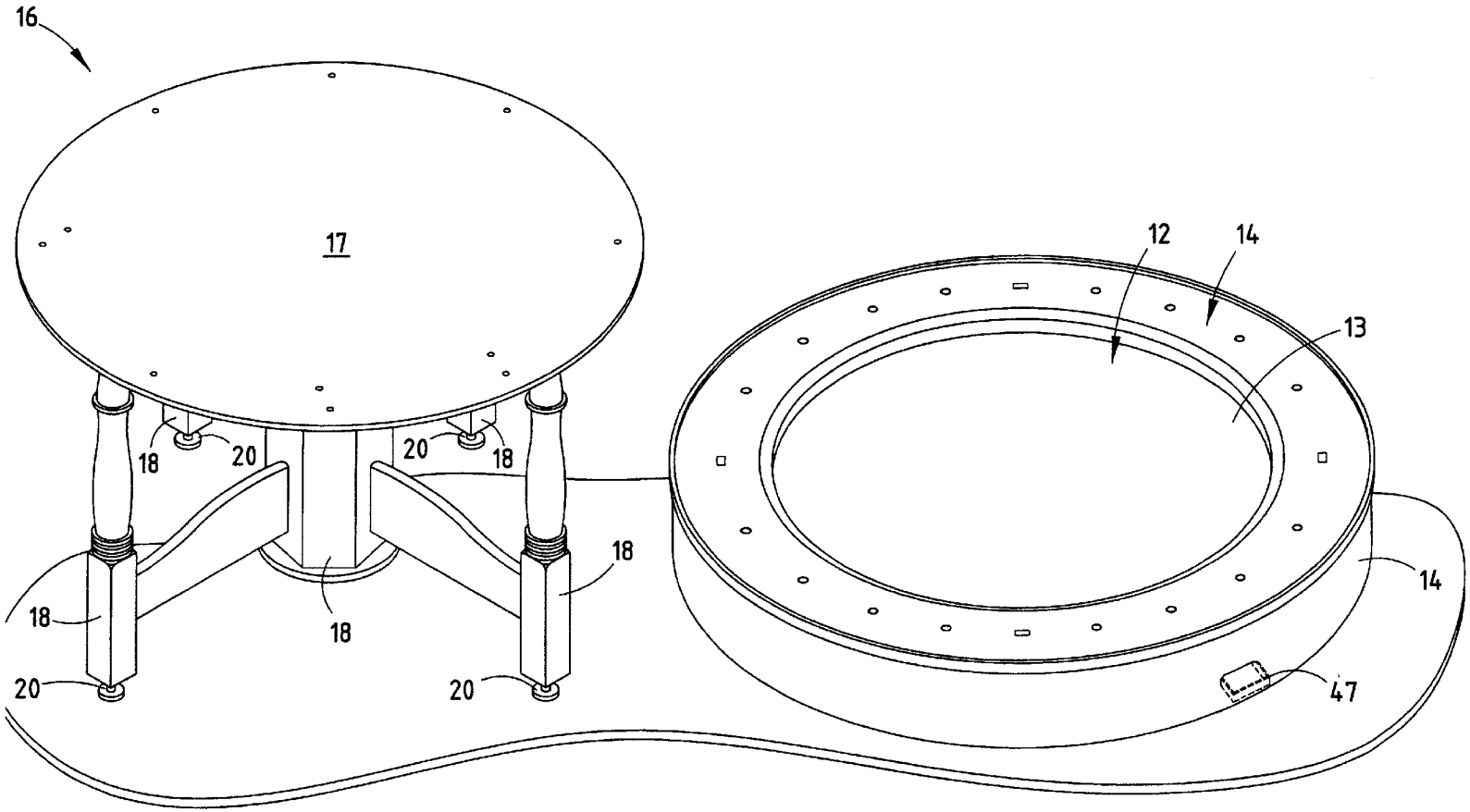
FIG. 10 is a perspective view of a marble table assembly of the present invention where the marble table section has been detached and placed on, for example, the ground or floor.

The marble table assembly 10 of the present invention typically includes a circular, substantially flat playing surface 12, which can be removed and placed on the ground or other surface and used to play marbles. The marble table assembly of the present invention also includes a table portion 16 and a removable marble table section 14, which itself may be disengaged from the table portion 16 and placed on the ground or other surface, as shown in FIG. 10, and used to play marbles. Table portion 16 adapted to receive the removable table section. The support surface 17 of table portion 16 is elevated above the ground or floor using any number of supports 18. Typically, there is at least one leveling adjustment device 20 mounted on supports 18.

Figure 8:
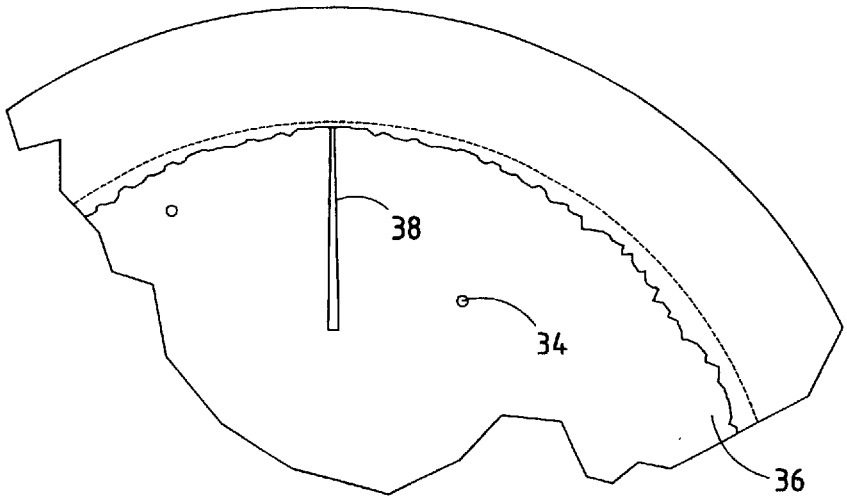
FIG. 8 is a partial view of the bottom surface of the playing surface showing an alignment mark that corresponds to the alignment line on the center sloped section and assists the marble player in mounting the playing surface on the support pegs as a support peg knob receiving cavity.

The removable substantially flat playing surface 12 has a top surface 13 and a bottom surface 36. As shown in FIG. 8, the bottom surface 36 may have at least one support peg receiving cavity 34 which corresponds to at least one support peg 30. The support peg receiving cavity is typically used, but is not necessary. Conceivably, playing surface 12 may be placed on the pegs without use of cavities. Optionally, a marble rack 11 typically made of wood, usually oak or wood that matches the table assembly construction material, may be used to position marbles at the proper spacing and at the proper location on the playing surface—typically centered at the plus (+) or other mark at the center of the playing surface. The typical marble rack 11 will rock ten marbles and be generally plus (+) shaped with 6 marbles positioned along one axis and 4 along another. Typically, the rack 11 has one axis that is about 8¼ inches long and another that is about 6 inches long. Conceivably, the rack 11 could be of any size or shape and could be configured to position any number of marbles in any pattern suitable for any given marble game.

The removable substantially flat playing surface may be constructed of any suitable construction material, such as, for example, wood, stone, plastic, slate, fiberglass, metal, or a composite directly or indirectly, or any combination of the above. The top surface 13, or playing surface, of the suitable rigid construction material may be covered with any material suitable to a marble player, such as for example, felt, carpet, foam, plastic, rubber, a blended or non-blended fabric. Removable substantially flat playing surface 12 may be any shape suitable for a marble game, but typically is a circle.

The diameter of playing surface 12 may vary depending upon the skill level of the players. The removable substantially flat playing surface 12 may have a diameter of about 40 inches to about 60 inches but more typically has a diameter of about 48 inches. The smaller diameter playing surface accommodates those of lesser skill while the larger diameter playing surface accommodates those of greater skill. The thickness of removable substantially flat playing surface 12 may be from about 1/10 inch to about 0.5 inch, but the thickness typically is about 0.1 inches. Optionally, multiple playing surfaces of various diameters may be employed in an embodiment of the present invention to accommodate varying skill levels of different players.

The underside of removable substantially flat playing surface 36 may have at least one alignment mark. The alignment mark(s) facilitates proper positioning of removable substantially flat playing surface 12 when placing the playing surface on removable table section 14. The playing surface alignment mark and the table section alignment mark when substantially aligned with one another, facilitating correct placement of playing surface and engagement of the playing surface on the support pegs.

Detachably engaged to support surface 17 is a typically circular main marble table section 14 (typically about 64 inches in diameter) that may have a sloped center section 24 and a marble retaining wall section 26 center section 22 that is typically about six to about seven inches high. An inwardly projecting upper rim or lip 28, which projects inwardly about six to about seven inches, about the perimeter of the sloped center section 24 may also be used in the present invention. Support surface 17 is typically flat to matingly engage the flat bottom surface of main marble table 10; however, conceivably any mating arrangement would be sufficient, including a spherical or dome interfitting.

Table portion 16 and the removable marble table section 24 may be constructed of any suitable rigid construction material, such as wood, plastic, fiberglass, metal, a composite, or veneer or any combination of the above. Typically, table portion 16 and the removable marble table section 24 are made of wood. Lip 28 may have an upper surface and a lower surface. Additionally, that edge portion or any part of lip 28, but typically the edge portion, which is exposed to contact with the marbles, may be covered by felt, foam, plastic, rubber, a blended or non-blended fabric, a similar soft decorative material or any combination of the above to prevent damage to a marble should it contact the lip. Typically, at least the edge of lip 28 is covered by felt.

There may also be one or more bubble levels 48 spaced about lip 28 or upper rim of marble table section 22 to assist in leveling playing surface 12. Typically, lip 28 has more than one bubble level 48 spaced appropriately apart from one another thereby allowing a person to adjust the leveling adjustment device(s) and level playing surface 12 on more than one plane. Leveling adjustment device(s) 20 are used on one or more supports 18 to aid in leveling marble table 10. Optionally, inlaid objects 50 may be spaced about lip or upper rim 28 for decoration. Such objects may include decorative marbles, dice, glass, name plates, metals, composites, or any other decorative inlaid objects.

Sloped center section 24 directs marbles that have fallen off removable substantially flat playing surface 12 toward marble return aperture 46 and optionally through marble return aperture 46 into marble retaining tray 47. Sloped center section 24 has a diameter about equal to or less than the diameter of the playing surface (or the largest playing surface if more than one sized playing surface is employed.

Sloped center section 24 may contain any number of support pegs 30 of various lengths. The support pegs operate to the suspend substantially flat playing surface in a substantially horizontal or substantially level position above sloped center section 24 of marble table section 22. Support pegs 30 may further include playing surface retention knobs 32, which assist in assuring proper placement and in the stability of the playing surface when the playing surface is on the support pegs. The support pegs and/or the playing surface retention knobs matingly engage support peg receiving cavities 34 on the underside 36 of the substantially flat playing surface 12. The configuration of support pegs 30 received in knob retention cavities 34 on underside 36 of substantially flat playing surface 12 keeps the playing surface stable while in use. The playing surface 12 is placed on support pegs 30 and positioned such that there is space enough between the lip of marble table section 22 and playing surface 12 for a marble to fall off of playing surface 12. Typically, the space between the lip and the playing surface is about one inch to about three inches, but usually is about 1.5 inches.

Figure 1:
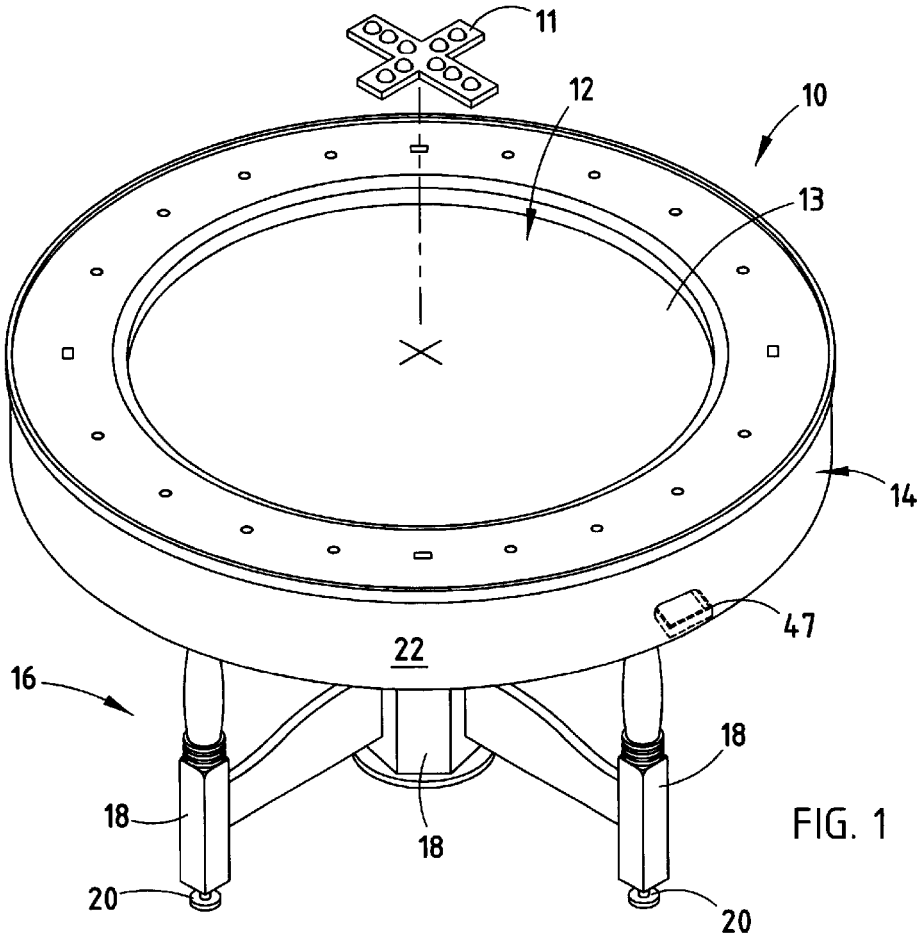
FIG. 1 is a perspective view of a marble table assembly embodying the present invention.
Figure 2:
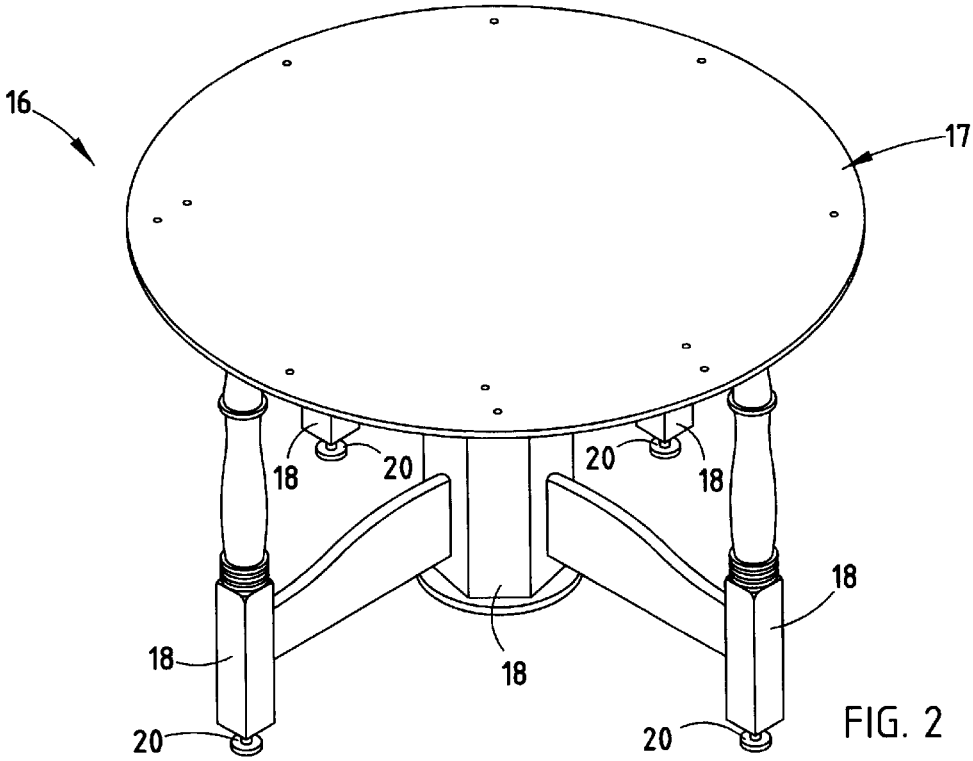
FIG. 2 is a perspective view of the elevated flat support surface and upright supports of an embodiment of the present invention.
Figure 3:
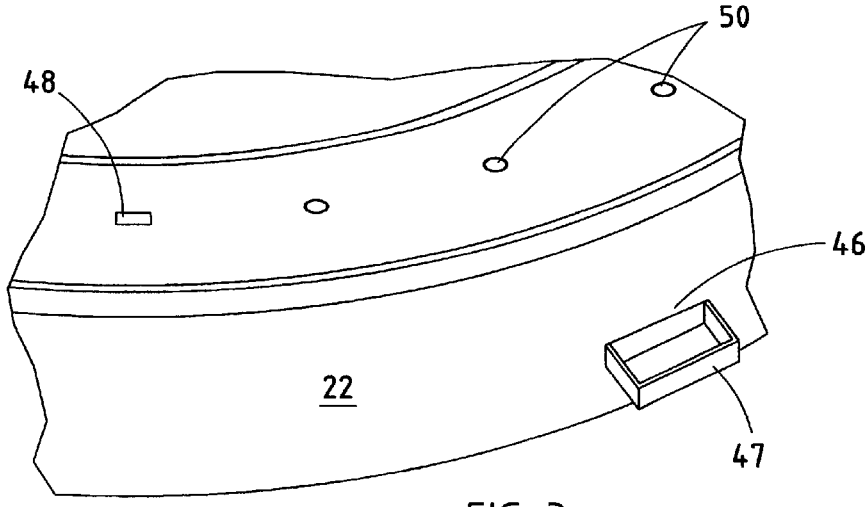
FIG. 3 is a partial perspective view of a marble table section of an embodiment of the present invention.
Figure 4:
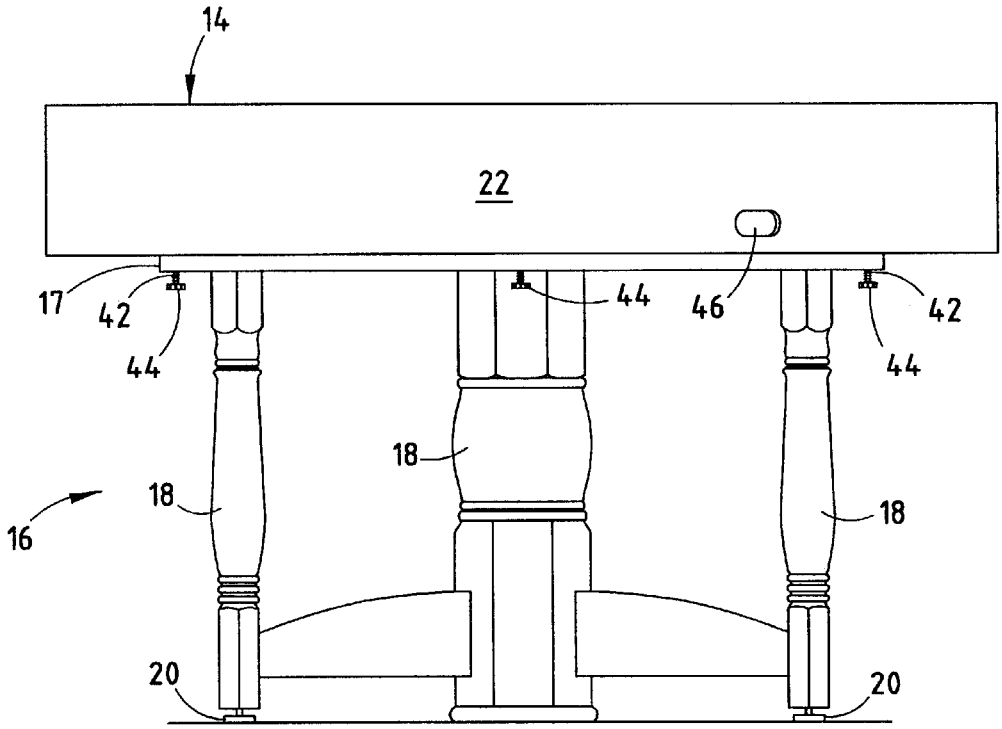
FIG. 4 is an elevated side view of the upright supports embodying the present invention.
Figure 5:
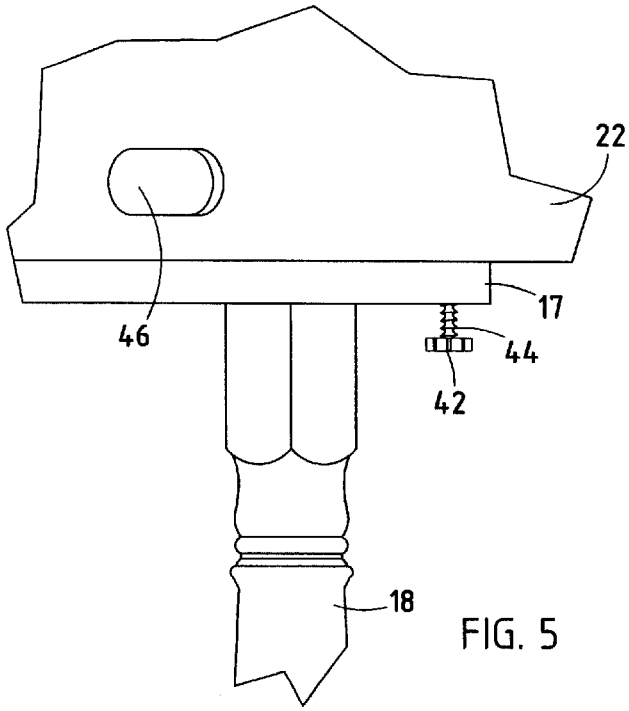
FIG. 5 is a partial elevated side view showing the marble table section engagement devices of an embodiment of the present invention.
Figure 6:
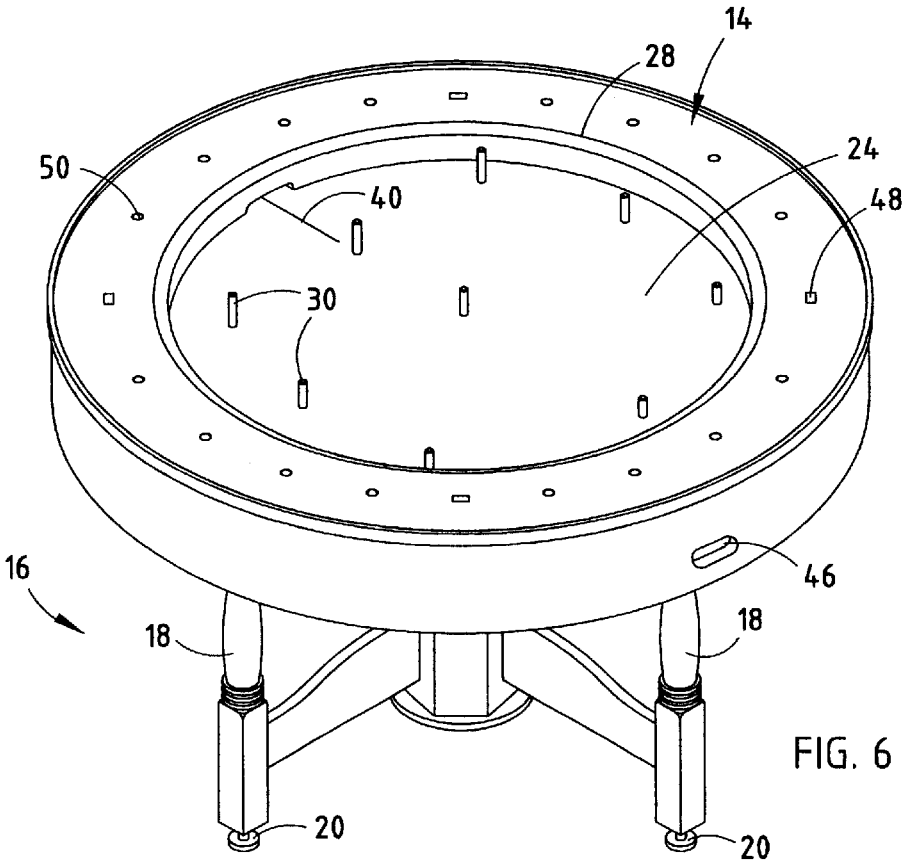
FIG. 6 is a perspective view of a marble table of the present invention where the playing surface has been removed.
Figure 7:
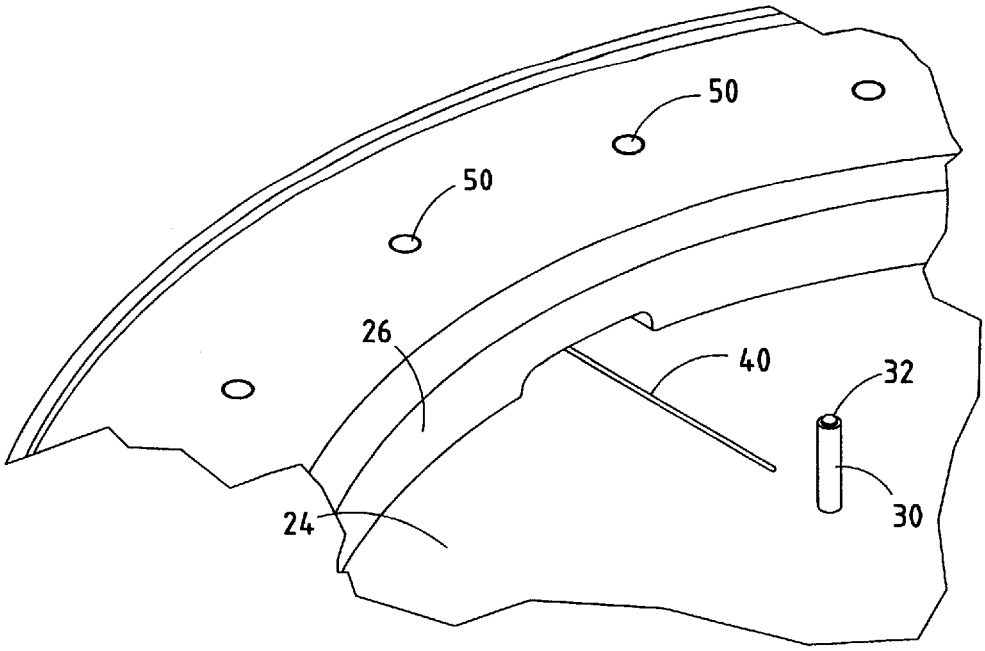
FIG. 7 is an enlarged perspective view of a portion of the sloped center section of the removable marble table section of a marble table of an embodiment of the present invention showing an alignment mark that assists the marble player in remounting of the playing surface of the support pegs and further shows a support peg retention peg and, which may be received by knob the support peg knob receiving cavities on the bottom surface of the playing surface.

As shown in FIGS. 7–8, to assist in aligning playing surface retention knobs 32 with support peg knob receiving cavities 34, a line or other alignment mark 38 is placed on underside 36 of substantially flat playing surface 12 and a corresponding line or other alignment mark 40 is placed on sloped center section 24 of main marble table section 22. When these lines or alignment marks are aligned as the removable playing surface is mounted onto the support pegs, the playing surface retention knobs readily matingly engage support peg receiving cavities 34 on underside 36 of substantially flat playing surface 12.

Figure 11:
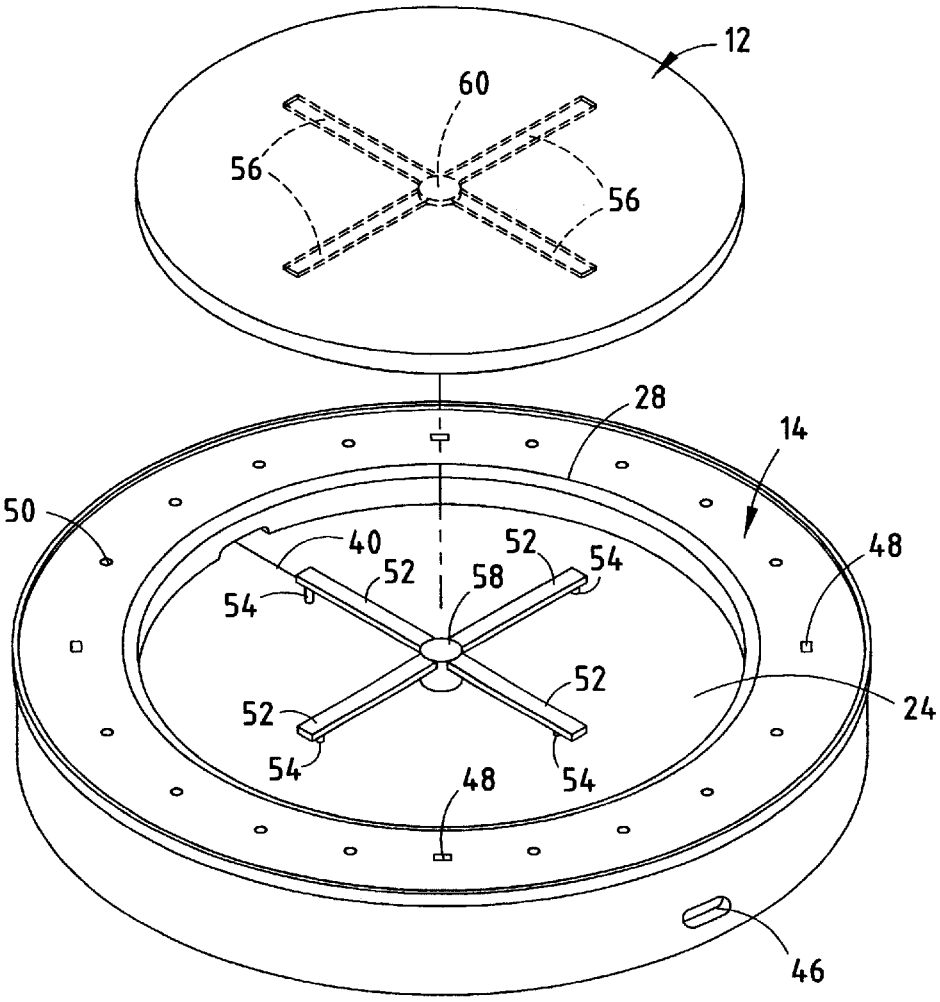
FIG. 11 is another embodiment of a table section and playing surface of the present invention.

Conceivably, any structure or configuration that operates to stabily suspend the playing surface substantially level above the sloped center section may be utilized in the present invention. While the support pegs are typically used, in another embodiment, a center support 58 may be positioned in substantially the center of the sloped center section. Extending out from the center support may be any number, but typically four, horizontally outwardly extending stabilizing members 52, which are strengthened by using strengthening support members 54. Support members 54 may be substantially vertical pegs, as shown in FIG. 11, or angled bars extending from the center support and engaging the stabilizing members, typically on the bottom surface of the stabilizing members. Stabilizing member receiving slots or grooves 56 may be cut into the bottom of the removable playing surface as well as a center support receiving cavity 60 such that the bottom of the playing surface is configured to matingly engage the center support and the horizontally, outwardly extending stabilizing members. When the configuration is used, the playing surface could be mounted on the center support receiving cavity and simply rotated until the stabilizing members engage the stabilizing member receiving slot(s) or groove(s).

Another structure to suspend the playing surface may or may not have a center section. In this structure, the stabilizing members could be cross-members extending across the diameter of the center section that optionally engage with the side walls of the table section and where the cross-members are further supported by support pegs. In such a configuration, the stabilizing members could be parallel, perpendicular, or at any angle to one another across the table. Typically, a parallel configuration would be used. Typically only two stabilizing members would be used, but any number could be employed. The stabilizing members may engage the bottom of the playing surface. A groove may be cut in the bottom of the playing surface to matingly receive the stabilizing members in the configuration as well.

Another structure for stabilizing the playing surface above includes a center post or a series of pegs that suspend a circular, ring, or other shaped stabilizing surface. The bottom of the playing surface could then engage this stabilizing surface. Typically, the bottom of the playing surface would further include a shaped cavity that is configured to matingly engage the shaped stabilizing surface. Typically, if the shaped stabilizing surface is a circle, a circular shaped stabilizing surface cavity is cut into the bottom of the playing surface.

Figure 9:
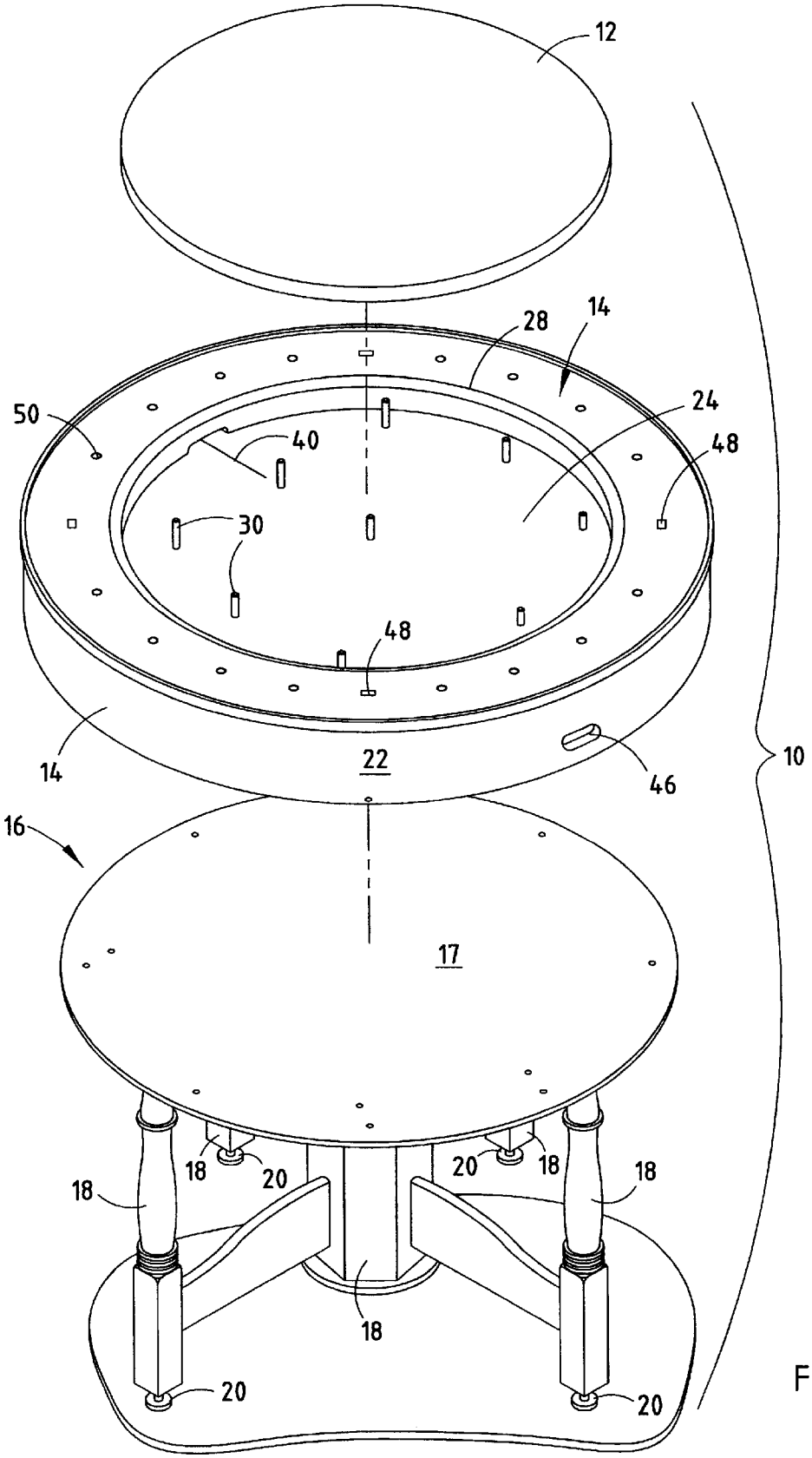
FIG. 9 is an exploded view of a marble table assembly of the present invention detached from the elevated flat support surface without the playing surface mounted thereon.

As seen in FIGS. 9–10, the entire marble table section 22 may be removed from elevated support surface 16 and placed on the ground or another surface to allow children and adults to play marbles using the marble table section of the present invention. A lowered playing surface is a benefit because it facilitates inclusion of all members of a group or family by allowing people of all heights to play the game while also allowing the very appealing elevated marble table assembly to be used and enjoyed by adults alone. Another significant benefit of the present invention to those individuals who, because they grew up playing marbles on the ground or are "marble purists" would prefer not to play marbles in a table-like environment, is the removable playing surface. For those individuals, the playing surface itself may be removed, placed on the ground or floor, and used to play the game nearer to the ground.

In order to remove the entire marble table section 22 from support surface 16, one or more engagement devices may be used. The engagement devices may be threaded bolts, anchors, or other devices or combination of devices for securing purposes. Typically, the engagement devices have hand grips 44 to provide greater leverage upon turning to make tightening and loosening easier and to make the use of the engagement devices comfortable to a user. There are typically four engagement devices, for example threaded anchors, mounted to underside 12 of the flat support surface 17 for retaining main marble table section 22 in a fixed, but detachable position on support surface 17.

The above description is considered that of the preferred embodiments only. Modification of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the Doctrine of Equivalents.

What is claimed is:

1. A marble table assembly comprising:

a table portion comprising a substantially flat support surface and at least one downwardly extending support member engaged with the substantially flat support surface and comprising a leveling adjustment device;

a removable playing surface comprising a top surface and a bottom surface where the bottom surface comprises at least one support peg receiving cavity and at least one playing surface alignment mark;

a removable marble table section comprising an upright marble retention section defining a sloped center section, a substantial flat bottom surface, an inwardly projecting portion, at least one support peg engaged to the sloped center section for suspending the removable playing surface substantially level above the sloped center section, and a table section alignment mark; and wherein the removable marble table section removably engages the substantially flat support surface and at least one support peg engages at least one support peg receiving cavity when the playing surface alignment mark and the table section alignment mark are substantially aligned with one another.

2. The marble table assembly of claim 1, wherein the removable marble table section further comprises a marble return aperture and marble receiving area wherein the sloped center section directs marbles that have fallen off the removable playing surface and onto the sloped center section toward the marble return aperture and into the marble return area.

3. The marble table assembly of claim 2, wherein at least the upper surface of the removable playing surface comprises felt.

4. The marble table assembly of claim 3, wherein the removable marble table section comprises wood.

5. The marble table assembly of claim 1, wherein the inwardly projecting portion further comprises at least one bubble level for assisting the leveling of the playing surface and the removable marble table section.

6. The marble table assembly of claim 1 further comprising an engagement device wherein the engagement device engages the removable table section with the support table.

7. The marble table assembly of claim 6, wherein the engagement device is threaded and passes from a bottom surface of the table, through the support surface and into a portion of the removable marble table section.

8. A marble table comprising:

a removable marble table section receiving support table comprising a substantially flat removable marble table section receiving support surface and at least one downwardly extending support member engaged with the substantially flat support surface where the support member further comprises a leveling adjustment device;

a removable playing surface comprising a top surface and a bottom surface comprising at least one support peg receiving cavity and at least one playing surface alignment mark, wherein the playing surface has a diameter;

a removable marble table section removably comprising an upright marble retention section defining a sloped center section having a diameter greater than the diameter of the playing surface and a bottom surface, a marble return opening wherein the sloped center section directs marbles that have fallen off the removable playing surface toward the marble return opening, an inwardly projecting portion, wherein the inwardly projecting portion extends over at least a portion of the removable playing surface and wherein the inwardly projecting portion comprises at least one bubble level for leveling the marble table, a table section alignment mark on at least a portion of the sloped center section, and a number of support pegs corresponding to the number of support peg receiving cavities on the bottom surface of the removable playing surface engaged to the sloped center section for supporting the removable playing surface substantially level above the sloped center section, wherein the support peg comprises a support peg knob to matingly engage the support peg cavities when the playing surface alignment mark and the table section alignment mark are aligned with one another; and wherein the removable marble table section removably engages the substantially flat support surface by utilizing at least one engagement device.

9. The marble table assembly of claim 8, wherein the removable table section and the support table are substantially comprised of wood.

10. A marble table assembly comprising:

a table comprising a support surface and at least one support leg engaged with the support surface;

a removable playing surface comprising a top surface, and a bottom surface where the bottom surface comprises at least one support peg receiving cavity;

a removable marble table section comprising an upright marble retention section defining a sloped center section and a bottom surface, a number of support pegs corresponding to the number of support peg receiving cavities on the bottom surface of the removable playing surface engaged to the sloped center section for supporting the removable playing surface above the sloped center section, wherein the removable marble table section removable engages the support surface thereby allowing the removable playing surface or the marble table section to be disengaged from the table and used at a location other than in connection with the table.

11. The marble table assembly of claim 10, wherein the removable playing surface comprises felt.

12. The marble table assembly of claim 11, wherein the removable marble table section comprises wood.

13. The marble table assembly of claim 10, wherein the removable marble table section further comprises a marble return aperture and marble return area and wherein the sloped center section directs marbles that have fallen off the removable playing surface toward the marble return aperture and into the marble receiving area.

14. The marble table assembly of claim 10, wherein the marble table section further comprises an inwardly projecting portion the extends over at least a portion of the playing surface when the playing surface is positioned on the support pegs and wherein the inwardly projecting portion comprises at least one bubble level.

15. The marble table assembly of claim 14, wherein the table support leg further comprises a leveling device.

16. The marble table assembly of claim 15 further comprising an engagement device wherein the engagement device engages the removable table section with the support table.

17. The marble table assembly of claim 14, wherein the bottom of the playing surface further comprises a playing surface alignment mark and the sloped Center section further comprises at least one table section alignment mark wherein the support peg knobs of the sloped center section matingly engage the support peg receiving cavities on the bottom of the playing surface when the playing surface alignment mark and the table section alignment mark are substantially aligned with one another.

18. A marble table assembly comprising:

a support table comprising a support surface and at least one downwardly extending support engaged with the support surface and comprising a leveling adjustment device;

a plurality of removable playing surfaces having different diameters to accommodate different marble player skill levels where each playing surface comprises a top surface and a bottom surface where the bottom surface comprises at least one support peg receiving cavity; and a marble table section comprising an upright marble retention section defining a sloped center section having a diameter about equal to or less than the diameter of the largest playing surface, a bottom surface, at least one support peg engaged to the sloped center section for suspending the removable playing surfaces substantially level and above the sloped center section.

19. The marble table assembly of claim 18, wherein the marble table section removably engages the support surface.

20. The marble table assembly of claim 19, wherein the bottom surface of at least one of the playing surfaces further comprises a playing surface alignment mark and the sloped center section of the marble table section further comprises at least one table section alignment mark and where at least one support peg engages at least one support peg receiving cavity when the playing surface alignment mark and the table section alignment mark are substantially aligned with one another.

21. The marble table assembly of claim 19, wherein the marble table section further comprises a marble receiving area positioned at the bottom of the sloped center section for receiving marbles that fall from the playing surface onto the sloped center section.

22. A marble table assembly comprising:

a table portion comprising a support surface and at least one downwardly extending supports member engaged with the substantially flat support surface;

a removable marble table section comprising an upright marble retention wall defining a sloped center section removably engaged with the table portion;

a removable playing surface comprising a top and bottom surface; and a means for suspending the removable playing surface substantially level above the center section.

23. The marble table assembly of claim 22, wherein the removable marble table section further comprises an aperture and wherein the center section is inclined thereby directing marbles that fall off the playing surface and onto the center section toward the aperture thereby offering easy retrieval of the marbles.

24. A marble table assembly comprising:

a table portion comprising a support surface and at least one downwardly extending supports member engaged with the substantially flat support surface;

a removable marble table section comprising an upright marble retention wall defining a sloped center section removably engaged with the table portion;

a removable playing surface comprising a top and bottom surface; and a playing surface support assembly comprising a support member engaged with the center section of the removable marble table section and at least one stabilizing member that engages and extends outwardly from the support member and where at least a portion of the playing surface support assembly engages the bottom surface of the removable playing surface.

25. The marble table assembly of claim 24, wherein the removable marble table section further comprises an aperture and wherein the center section is inclined thereby directing marbles that fall off the playing surface and onto the center section toward the aperture thereby offering easy retrieval of the marbles.

26. The marble table assembly of claim 24, wherein the bottom surface of the removable playing surface comprises at least one stabilizing member receiving area and the playing surface support assembly further comprises at least one strengthening member engaged at one end with either the support member or the sloped center section and at the other end with the outwardly extending stabilizing member.

27. The marble table assembly of claim 26, wherein the stabilizing member receiving area comprises a groove.

* * * * *

UNITED STATES PATENT AND TRADEMARK OFFICE

CERTIFICATE OF CORRECTION

PATENT NO. : 6,669,194 B2
DATED : December 30, 2003
INVENTOR(S) : Isiah Houston Jr.

It is certified that error appears in the above-identified patent and that said Letters Patent is hereby corrected as shown below:

Column 9,
Line 24, "Center" should be -- center --

Signed and Sealed this

Eighteenth Day of May, 2004

JON W. DUDAS
*Acting Director of the United States Patent and Trademark Office*